US008562110B2

(12) United States Patent
Zhao et al.

(10) Patent No.: US 8,562,110 B2
(45) Date of Patent: Oct. 22, 2013

(54) INK JET PRINT HEAD FRONT FACE HAVING A TEXTURED SUPEROLEOPHOBIC SURFACE AND METHODS FOR MAKING THE SAME

(75) Inventors: Hong Zhao, Webster, NY (US); Kyoo-Chul Park, Cambridge, MA (US); Kock-Yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/541,473

(22) Filed: Jul. 11, 2012

(65) Prior Publication Data

US 2012/0268524 A1 Oct. 25, 2012

Related U.S. Application Data

(63) Continuation-in-part of application No. 12/648,004, filed on Dec. 28, 2009.

(51) Int. Cl.
*B41J 29/38* (2006.01)

(52) U.S. Cl.
USPC ..... 347/47

(58) Field of Classification Search
USPC ..... 347/47, 40, 43
See application file for complete search history.

(56) References Cited

U.S. PATENT DOCUMENTS

| | | | | |
|---|---|---|---|---|
| 5,867,189 | A | 2/1999 | Whitlow | |
| 8,226,210 | B2 * | 7/2012 | Otokita | 347/47 |
| 8,277,024 | B2 * | 10/2012 | McAvoy et al. | 347/47 |
| 8,449,078 | B2 * | 5/2013 | Nagatsuka | 347/56 |
| 2007/0123606 | A1 | 5/2007 | Toma et al. | |
| 2009/0046125 | A1 | 2/2009 | Nystrom et al. | |

* cited by examiner

*Primary Examiner* — Lamson Nguyen
(74) *Attorney, Agent, or Firm* — Pillsbury Winthrop Shaw Pittman LLP

(57) ABSTRACT

An ink jet print head front face or nozzle plate having a textured superoleophobic surface that prevents undesirable drooling, wetting and/or adhesion of the ink on the print head. The textured surface includes a rim formed around the nozzle. Also described are methods for forming the textured superoleophobic ink jet print head front face or nozzle plate from silicon having the textured, oleophobic surface.

22 Claims, 4 Drawing Sheets

INK JET PRINT HEAD FRONT FACE HAVING A TEXTURED SUPEROLEOPHOBIC SURFACE AND METHODS FOR MAKING THE SAME

CROSS-REFERENCE TO RELATED APPLICATIONS

The present application is a continuation-in-part of U.S. patent application Ser. No. 12/648,004, filed Dec. 28, 2009.

Reference is also made to commonly owned and co-pending, U.S. patent application to Hong Zhao et al., filed the same day as the present application, entitled, "Ink Jet Print Head Front Face Having a Textured Superoleophobic Surface and Methods for Making the Same", the entire disclosures of which are incorporated herein by reference in its entirety.

BACKGROUND

The present embodiments include an ink jet print head front face or nozzle plate having a textured superoleophobic surface that prevents undesirable drooling, wetting and/or adhesion of the ink on the print head. The textured surface includes a rim formed around the nozzle. Also described are methods for forming the textured superoleophobic ink jet print head front face or nozzle plate from silicon having the textured, oleophobic surface. The methods include using superoleophobic surfaces prepared using photolithography to create a textured pattern in the silicon. In specific embodiments, the flexible, superoleophobic device made is used as a front face or nozzle plate surface for a microelectromechanical system (MEMSJet) based drop ejector print head.

Fluid ink jet systems typically include one or more printheads having a plurality of ink jets from which drops of fluid are ejected towards a recording medium. The ink jets of a printhead receive ink from an ink supply chamber or manifold in the printhead which, in turn, receives ink from a source, such as a melted ink reservoir or an ink cartridge. Each ink jet includes a channel having one end in fluid communication with the ink supply manifold. The other end of the ink channel has an orifice or nozzle for ejecting drops of ink. The nozzles of the ink jets may be formed in an aperture or nozzle plate that has openings corresponding to the nozzles of the ink jets. During operation, drop ejecting signals activate actuators in the ink jets to expel drops of fluid from the ink jet nozzles onto the recording medium. By selectively activating the actuators of the ink jets to eject drops as the recording medium and/or printhead assembly are moved relative to one another, the deposited drops can be precisely patterned to form particular text and graphic images on the recording medium. MEMSJet drop ejectors consist of an air chamber under an ink chamber, with a flexible membrane in-between. Voltage is applied to an electrode inside the air chamber, attracting the grounded flexible membrane downward, increasing the volume of the ink chamber and thus lowering its pressure. This causes ink to flow into the ink chamber from the ink reservoir. The electrode is then grounded and the membrane's restoring force propels it upward, creating a pressure spike in the ink cavity that ejects a drop from the nozzle. An example of a full width array printhead is described in U.S. Patent Publication 20090046125, which is hereby incorporated by reference herein in its entirety. An example of an ultra-violet curable gel ink which can be jetted in such a printhead is described in U.S. Patent Publication 20070123606, which is hereby incorporated by reference herein in its entirety. An example of a solid ink which can be jetted in such a printhead is the Xerox ColorQube™ cyan solid ink available from Xerox Corporation. U.S. Pat. No. 5,867,189, which is hereby incorporated by reference herein in its entirety, describes an ink jet print head including an ink ejecting component which incorporates an electropolished ink-contacting or orifice surface on the outlet side of the printhead.

One difficulty faced by fluid ink jet systems is wetting, drooling or flooding of inks onto the printhead front face. Such contamination of the printhead front face can cause or contribute to blocking of the ink jet nozzles and channels, which alone or in combination with the wetted, contaminated front face, can cause or contribute to non-firing or missing drops, undersized or otherwise wrong-sized drops, satellites, or misdirected drops on the recording medium and thus result in degraded print quality. Current printhead front face coatings are typically coated with a hydrophobic coating, for example, a sputtered polytetrafluoroethylene coating. However, the ink as an organic matter behaves differently than water, and can demonstrate ink-philic characteristics with the front face surface. When the printhead is tilted, the UV gel ink at a temperature of about 75° C. (75° C. being a typical jetting temperature for UV gel ink) and the solid ink at a temperature of about 105° C. (105° C. being a typical jetting temperature for solid ink) do not readily slide on the printhead front face surface. Rather, these inks flow along the printhead front face and leave an ink film or residue on the printhead which can interfere with jetting. For this reason, the front faces of UV and solid ink printheads are prone to be contaminated by UV and solid inks. In some cases, the contaminated printhead can be refreshed or cleaned with a maintenance unit. However, such an approach introduces system complexity, hardware cost, and sometimes reliability issues. Further, the front face coatings sometimes have trouble withstanding the chemistry of the ink, and repeated wiping from a maintenance wiper blade often clears away much of the coating, resulting in more severe ink wetting and flowing on the nozzle plate surface, leaving residues. Additionally, full-width array printheads made up of a series of subunits must be potted to fill in the cracks between units, in order to avoid damage to the wiper blade from the edges of the subunits. This can make reworking of the print heads very difficult because the potting must be removed and reapplied after the new subunit is inserted.

There remains a need for an ink jet print head and method for preparing same wherein the front face or nozzle plate exhibits superoleophobic characteristics alone or in combination with superhydrophobic characteristics. Further, while currently available coatings for ink jet printhead front faces are suitable for their intended purposes, a need remains for an improved printhead front face design that reduces or eliminates wetting, drooling, flooding, or contamination of UV or solid ink over the printhead front face. There further remains a need for an improved printhead front face design that is ink phobic, that is, oleophobic, and robust to withstand maintenance procedures such as wiping of the printhead front face. There further remains a need for an improved printhead front face design that is superoleophobic and, in embodiments, that is both superoleophobic and superhydrophobic. There further remains a need for an improved printhead that is easily cleaned or that is self-cleaning, thereby eliminating hardware complexity, such as the need for a maintenance unit, reducing run cost and improving system reliability.

The appropriate components and process aspects of the each of the foregoing U.S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

In embodiments, there is provided an ink jet print head front face or nozzle plate having a textured superoleophobic surface comprising: a silicon substrate having a front side and a back side; an ink reservoir formed in the back side of the silicon substrate; textured pattern formed into a front side of the silicon substrate; one or more nozzle holes formed into the silicon substrate to form one or more nozzle holes for the ink jet print head front face or nozzle plate; and a ring formed around a circumference of the one or more nozzle holes; and a conformal oleophobic coating disposed on the textured pattern, wherein the textured pattern comprises an array of pillars, grooves, and combination thereof.

In further embodiments, there is provided an ink jet print head front face or nozzle plate comprising: a silicon substrate; a textured pattern formed into one side of the silicon substrate; one or more nozzle holes formed into the one side of the silicon substrate to form one or more nozzle holes in the ink jet print head front face or nozzle plate; a ring formed around a circumference of the one or more nozzle holes; and a conformal oleophobic coating disposed on the textured pattern, wherein the conformal oleophobic coating comprises one or more fluorosilane layers synthesized through molecular vapor deposition, vapor phase technique or solution coating techniques and further comprises a self-assembled layer synthesized from the group consisting of tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, and heptadecafluoro-1,1,2,2-tetrahydrooctyltriethoxysilane. As used herein, "self-assembled" means assembling the tridecafluoro-1,1,2,2-tetrahydrooctyl or the heptadecafluoro-1,1,2,2-tetrahydrooctyl chain by first hydrolyzing the silane precursor, followed by co-valently bond the silane onto the silicon surface with a simultaneous crosslinking among the partially hydrolyzed silanes to form a two dimension network on the silicon surface.

In yet further embodiments, there is provided an ink jet print head front face or nozzle plate comprising: a silicon substrate; a textured pattern formed into one side of the silicon substrate; one or more nozzle holes formed into the one side of the silicon substrate to form one or more nozzle holes in the ink jet print head front face or nozzle plate; and a ring formed around a circumference of the one or more nozzle holes; and a conformal oleophobic coating disposed by e-beam deposition, thermal deposition, sputtering or solution coating techniques on the textured pattern, wherein the conformal oleophobic coating comprises one or more of coating materials selected from the group consisting of an amorphous fluoropolymer such as AF1600 and AF2400 from DuPont, a perfluoropolyether polymer such Fluorolink-D, Fluorolink-E10H or the like from Solvay Solexis.

DETAILED DESCRIPTION

Figure 1:
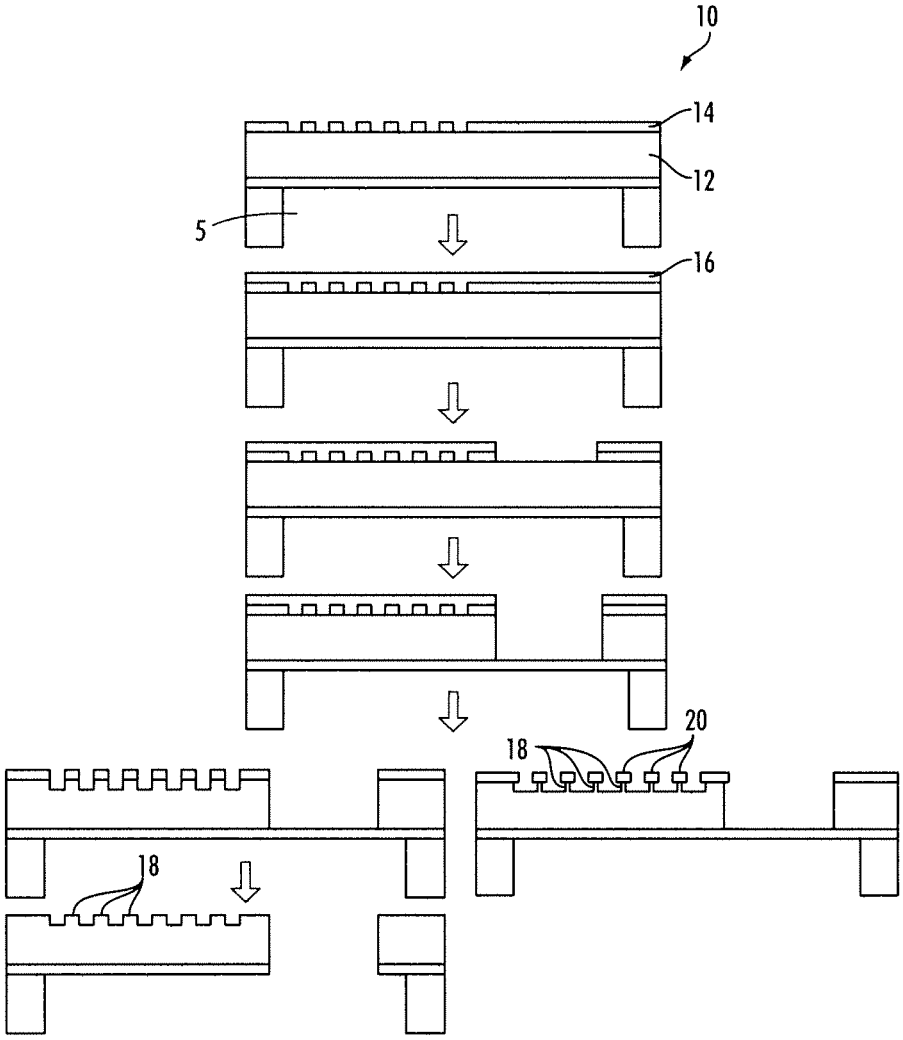
FIG. 1 is a flow diagram illustrating a process scheme for creating nozzle apertures and preparing a textured surface having wavy sidewalls (left branch) and for preparing a textured surface having overhang re-entrant structures (right branch) according to the present embodiments.

Described is a process for preparing an ink jet print head front face or nozzle plate having a textured highly oleophobic or superoleophobic surface, comprising providing a silicon substrate and using photolithography to create a textured pattern in the silicon substrate. In embodiments, the textured surface is modified by disposing a conformal, oleophobic coating thereon to provide a textured oleophobic silicon. In embodiments, the textured pattern comprises an array of pillars and/or grooves. In specific embodiments, the textured oleophobic silicon is used in forming an ink jet print head front face or nozzle plate. In such embodiments, the textured surface is a highly oleophobic surface or a superoleophobic surface, and, in embodiments, a surface that is both superoleophobic and superhydrophobic.

Contact Angle-Oleophobicity.

Highly oleophobic as used herein can be described as when a droplet of hydrocarbon-based liquid, for example, ink, forms a high contact angle with a surface, such as a contact angle of from about 90° to about 175° or from about 120° to about 170°. Superoleophobic as used herein can be described as when a droplet of hydrocarbon-based liquid, for example, ink, forms a high contact-angle with a surface, such as a contact angle that is greater than 150°, or from greater than about 150° to about 175°, or from greater than about 150° to about 160°.

Sliding Angle-Oleophobicity.

Superoleophobic as used herein can also be described as when a droplet of a hydrocarbon-based liquid, for example, hexadecane, slides on an inclined surface from about 1° to less than about 30°, or from about 1° to less than about 25°, or a sliding angle of less than about 25°, or a sliding angle of less than about 15°, or a sliding angle of less than about 10°.

Contact Angle-Hydrophobicity.

Highly hydrophobic as used herein can be described as when a droplet of water forms a high contact angle with a surface, such as a contact angle of from about 90° to about 180°. Superhydrophobic as used herein can be described as when a droplet of water forms a high contact angle with a surface, such as a contact angle of greater than about 150°, or from greater about 150° to about 180°.

Sliding Angle-Hydrophobicity.

Superhydrophobic as used herein can be described as when a droplet of water slides when the surface forms a sliding angle, such as a sliding angle of from about 1° to less than about 30°, or from about 1° to about 25°, or a sliding angle of less than about 15°, or a sliding angle of less than about 10°.

Oleophobic Coating.

Oleophobic coating as used herein can be described as the coating on which a droplet of hydrocarbon-based liquid, for example, hexadecane, forms a contact angle of larger than about 55°.

Superoleophobic textured patterns comprising an array of pillars can be provided on the silicon substrate. The array of pillars can be defined as an array of pillars having textured or wavy vertical sidewalls and an overhang re-entrant structure defined on the top of the pillars or a combination thereof. Textured or wavy sidewalls as used herein can mean roughness on the sidewall which is manifested in the size range smaller than the diameter of the pillar. In embodiments, the wavy sidewalls can have a 100-500 nanometer wavy structure with each wave corresponding to an etching cycle as described herein below. Textured patterns comprising a groove structure, in embodiments, micrometer and nanometer sized grooves, can also be provided on the silicon substrate. In embodiments, the groove structure comprises textured or wavy patterned vertical side walls and an overhang re-entrant structure defined on the top surface of the groove structure, or a combination thereof.

Textured patterns comprising an array of pillars or grooves can be created on the silicon using photolithography, e-team, X-ray and other optical interference techniques. For example, the silicon substrate can be prepared and cleaned in accordance with known cleanroom methods commonly practiced in the semiconductor industry. A photo resist can then be applied, such as by spin coating or slot die coating the photo resist material onto the silicon. Any suitable photo resist can be selected. In embodiments, the photo resist can be Mega™ Posit™ SPR™ 700 photo resist available from Rohm and Haas.

The photo resist can then be exposed and developed according to methods as known in the art, typically by exposure to ultraviolet light and exposure to a developer such as a sodium hydroxide containing developer or a metal-ion free developer such as tetramethylammonium hydroxide.

A textured pattern comprising an array of pillars or grooves can be etched by any suitable method as known in the art. Generally, etching can comprise using a liquid or plasma chemical agent to remove layers of the silicon that are not protected by the mask. In embodiments, deep reactive ion etching techniques (e.g. Bosch etching process) can be employed to produce the pillar/groove structures with wavy side wall. In embodiments, Fluorine based reactive ion etching ($CH_3F/O_2$) and ($SF_6/O_2$) processes can be used to create the textured pillars having overhang re-entrant structures. Optionally a Xenon difluoride isotropic etching process can be applied to enhance the degree of overhang.

After the etching process, the photo resist can be removed by any suitable method. For example, the photo resist can be removed by using a liquid resist stripper or a plasma-containing oxygen. In embodiments, the photo resist can be stripped using an $O_2$ plasma treatment such as the GaSonics Aura 1000 ashing system available from Surplus Process Equipment Corporation, Santa Clara, Calif. Following stripping, the substrate can be cleaned, such as with a hot piranha cleaning process.

After the surface texture is created on the silicon substrate, the surface texture can be modified, such as chemically modified. Chemically modifying the silicon substrate as used herein can comprise any suitable chemical treatment of the substrate, such as to provide or enhance the oleophobic quality of the textured surface. For example, a conformal fluorosilane coating can be disposed on the pillar surface. In embodiments, chemically modifying the textured substrate surface comprises disposing a self assembled layer consisting of perfluorinated alkyl chains onto the textured silicon surface. A variety of technology, such as the molecular vapor deposition technique, the chemical vapor deposition technique, or vapor phase technique, or the solution coating technique can be used to deposit the self assembled layer of perfluorinated alkyl chains onto the textured silicon surface. In embodiments, chemically modifying the textured silicon substrate comprises chemical modification by self-assembling a fluorosilane coating onto the textured silicon surface conformally via a molecular vapor deposition technique, a chemical vapor deposition technique, or a solution self assembly technique. In a specific embodiment, chemically modifying the textured silicon substrate comprises disposing layers assembled by tridecafluoro-1,1,2,2-tetrahydrooctyltrichlorosilane (informally known as fluoro-octyl-trichlorosilane or (FOTS), tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, heptadecafluoro-1,1,2,2-tetrahydrooctyltriethoxysilane, or a combination thereof, and the like, using the molecular vapor deposition technique or the solution coating technique.

According to various embodiments, the superoleophobic surface features one or more surface textures may be solution coated or by e-beam, thermal and sputtering techniques with an amorphous fluoropolymer such as AF1600 and AF2400 from DuPont; or a perfluoropolyether polymer such Fluorolink-D, Fluorolink-E10H or the like from Solvay Solexis.

The pillar array can have any suitable spacing or pillar density or solid area coverage. In embodiments, the array of pillars has a solid area coverage of from about 0.5% to about 50%, or from about 1% to about 20%. The pillar array can have any suitable spacing or pillar density. In a specific embodiment, the array of pillars has a pillar center-to-pillar center spacing of about 6 micrometers.

The pillar array can have any suitable shape. In embodiments, the array of pillars can be round, elliptical, square, rectangular, triangle, star-shaped or the like.

The pillar array can have any suitable diameter or equivalent diameter. In embodiments, the array of pillars can have diameter of from about 100 nm to about 10 micrometers, or from about 200 nm to about 5 micrometers.

The pillars can be defined at any suitable or desired height. In embodiments, the textured silicon can comprise an array of pillars having a pillar height of from about 100 nm to about 10 micrometers, or from about 200 nm to about 5 micrometers, or from about 0.5 micrometers to about 3 micrometers.

The groove structure can have any suitable spacing or pillar density or solid area coverage. In embodiments, the groove structure has a solid area coverage of from about 1% to about 80%, or from about 1% to about 50%.

The groove structure can have any suitable width and pitch. In a specific embodiment, the groove structure has a width of from about 100 nm to about 10 micrometers, or from about 200 nm to about 5 micrometers, or about 3 micrometers. Further, in embodiments, the groove structure has a groove pitch of from about 200 nm to about 15 micrometers, or from about 500 nm to about 12 micrometers, or about 6 micrometers. The groove structure can have any suitable length. In specific embodiments, the groove structure has a length of from 3 times of the width of the grooves up to any suitable length.

The textured patterned structures herein, in embodiments, pillar or groove structures, can have any suitable shape. In embodiments, the overall textured structure can have or form a configuration designed to form a specific pattern. For example, in embodiments, the pillar or groove structure can be formed to have a configuration selected to direct a flow of liquid in a selected flow pattern.

The groove structure can be defined at any suitable or desired total height. In embodiments, the textured surface can comprise groove pattern having a total height of from about 100 nm to about 10 micrometers, or from about 200 nm to about 5 micrometers, or from about 500 nm to about 5 micrometers.

The silicon materials having superoleophobic surfaces for forming ink jet print head front faces or nozzle plates herein can be prepared by any suitable method. In specific embodiments, the print head silicon nozzle plate herein comprises a silicon nozzle plate comprising deep reactive ion-etched (DRIE) nozzles. The nozzle plate consists of a SOI (Silicon-On-Insulator) wafer that is ground and polished to the desired thickness, such as, but not limited to, about 20 to about 30 micrometers, although any thickness that renders the material planar enough to be suitable for further photolithography and processing is suitable. The remainder of the process comprises patterning and etching of surface modification features, and patterning and etching of the nozzles. The problem is that the nozzles can't be done first because they would prevent further photolithography (the deep holes would interfere with the spinning of photoresist), but the surface modification can't be done first because the photoresist won't stick to the resulting hydrophobic surface.

Turning to FIG. 1, the present process comprises performing both of the patterning steps, surface modification and nozzle formation, at the beginning of the process, for example by using masking layers to temporarily "store" the pattern information, and then performing the etching. The left branch of FIG. 1 leads to pillars or grooves having wavy sidewalls, depending on the details of the mask. The right branch of FIG. 1 results in pillars or grooves having overhang re-entrant structures, or "T-topped" posts/pillars/grooves with caps.

In specific embodiments, a silicon substrate 12, has disposed thereon a material 14 (e.g. silicon dioxide) that can be selectively etched without attacking the substrate 12. In embodiments, the substrate is etched on one side to form an ink reservoir 5. In embodiments, a second material 16 (e.g. silicon nitride) that can be selectively etched without attacking the silicon substrate 12 or the first material 14 can be deposited and etched to create the nozzle apertures in the silicon substrate on the other side using known photolithographic methods. The desired pattern can be etched using known photolithographic methods to prepare a textured silicon substrate having an array of pillars or grooves 18 (left branch) or to prepare the textured silicon surface having an array of pillars or grooves 18 with overhang re-entrant structures 20 (right branch). After surface texturing, the entire patterned surface is coated with a conformal oleophobic coating (not shown), such as a self-assembled layer (FOTS) synthesized from fluorooctyltrichlorosilane or fluorodecyltrichlorosilane (FDTS), as described earlier. This will impart superoleophobicity on the entire front face.

Figure 2:
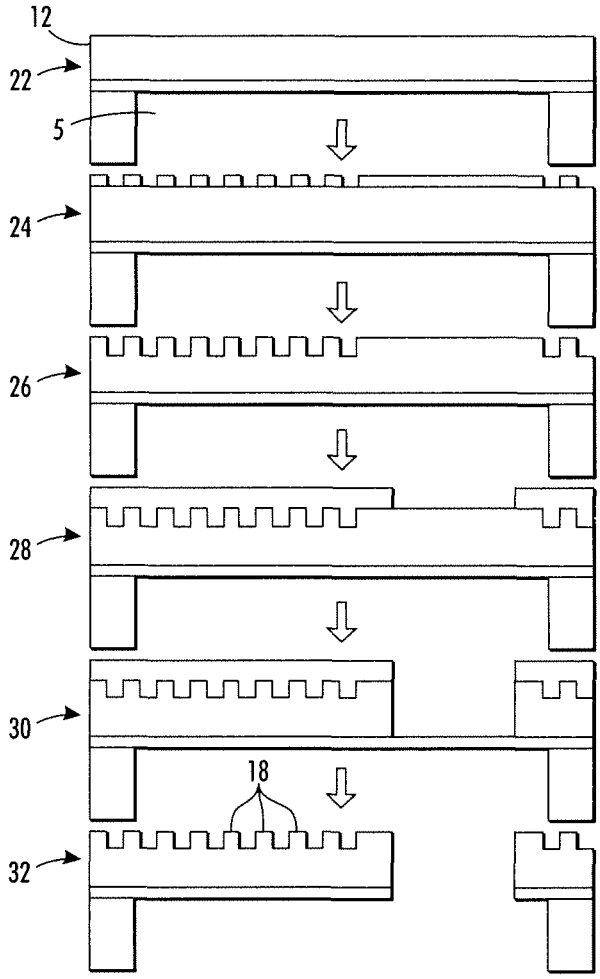
FIG. 2 is a flow diagram illustrating an alternative process scheme for creating nozzle apertures and preparing a textured surface having pillars/grooves with wavy side walls according to the present embodiments.

Turning to FIG. 2, an alternative process for making superoleophobic surfaces for forming ink jet print head front faces or nozzle plates is provided, more specifically, a process for making pillars/grooves with wavy side walls. The difference between the processes depicted in FIGS. 1 and 2 is the order of patterning of resist layers and etching for the superoleophobic textured surface and nozzles in the silicon substrates.

In FIG. 2, a hole is created on the back side of a substrate 12, such as, a double-side polished SOI wafer (Silicon-On-Insulator), by using the backside alignment method of contact aligners with a first photomask and using dry etching, such as for example, through the Bosch process 22. Backside alignment method is a well-known technique in photolithography process to align the front and back side of the wafer using fiducial marks on the photomask and/or etching. This forms the ink reservoir 5. The ink reservoir hole may have a diameter of from about 20 to about 200 micrometers, or from about 30 to about 150 micrometers, and a depth of from about 300 to about 2000 micrometers, or from about 500 to about 1500 micrometers. In a specific embodiment, the diameter of the ink reservoir hole has a diameter of 100 micrometer and a depth of 370 micrometer on the SOI wafer, a thin layer, for example, from about 100 nm to about 500 nm, or specifically 300 nm, of silicon oxide is buried and sandwiched between the top silicon layer and the back silicon layer to make an etch stop for the next steps.

The texture pattern for superoleophobic regions is transferred onto the positive photoresist layer on the front side of the substrate using stepper system (with a second photomask) 24. The front side is anisotropically etched to form the pillars and/or grooves with wavy side wall 26. The etch depth or texture height can be from about 0.1 to about 5 micrometer. A thick photoresist is spincoated or spray coated on the front side of the substrate 28, and patterned the nozzle hole using the stepper and a third photomask. The thick photoresist layer may be from about 1 to about 15 micrometer. In specific embodiments, the thickness is about 6 micrometer. The front side is then etched 30 to create the nozzle hole and the anisotropic etching process is stopped by etching selectivity between silicon and silicon oxide (layer). The etch depth may be from about 20 to about 50 micrometers, or from about 25 to about 45 micrometers. In specific embodiments, the etch depth is about 30 micrometer. In further embodiments, the diameter of the nozzle hole has a diameter of from about 20 to about 60 micrometers, or from about 30 to about 50 micrometers. In specific embodiments, the diameter of the nozzle hole is 40 micrometer. Thus, in specific embodiments, the texture pattern is made by patterning and etching in one layer and subsequently patterning and etching in a second layer.

The etch stopper layer (silicon oxide) is removed by the buffered oxide etch (BOE) process 32 and the final structure (pillars/grooves 18) is ready for surface modification with an oleophobic conformal coating. After surface texturing, the entire patterned surface is coated with a conformal oleophobic coating (not shown), such as a self-assembled layer (FOTS) synthesized from fluorooctyltrichlorosilane or fluorodecyltrichlorosilane (FDTS), as described earlier. This will impart superoleophobicity on the entire front face.

Figure 3:
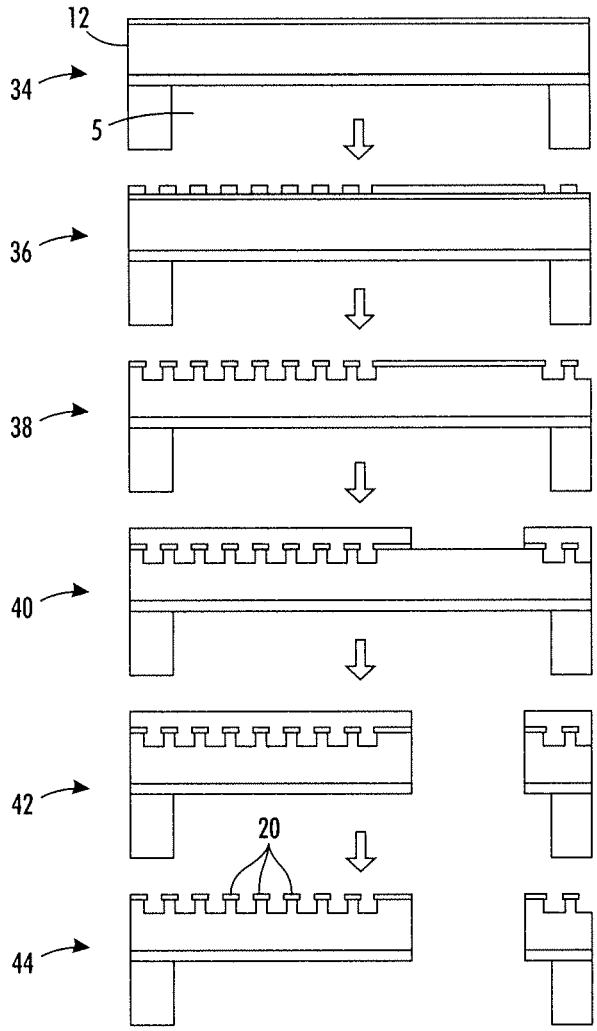
FIG. 3 is a flow diagram illustrating an alternative process scheme for creating nozzle apertures and preparing a textured surface having pillars/grooves with overhang re-entrant structures according to the present embodiments.

Turning to FIG. 3, a process for making superoleophobic surfaces with overhang re-entrant structures on nozzle plates is provided. The difference between the processes depicted in FIGS. 2 and 3 is the method of fabricating the superoleophobic structure: wavy side walled pillars/grooves in FIG. 2 and the re-entrant overhang structures in FIG. 3.

In FIG. 3, the process can comprise providing a substrate 12, such as a double-side polished SOI wafer (Silicon-On-Insulator) 34. This SOI wafer can have disposed thereon a thin silicon oxide layer, such as via plasma enhanced chemical vapor deposition or low pressure chemical vapor deposition. The thin silicon oxide layer can have a thickness of from about 50 nanometers to about 2 micrometers, or from 100 nanometer to 1 micrometer. A hole is created on the back side of the double-side polished SOI wafer, by using the backside alignment method of contact aligners with a first photomask and using dry etching, such as for example, through the Bosch etching process. This forms the ink reservoir 5. The ink reservoir hole may have a diameter of from about 40 to about 200 micrometers, or from about 50 to about 150 micrometers, and a depth of from about 300 to about 2000 micrometers, or from about 500 to about 1500 micrometers. In a specific embodiment, the diameter of the ink reservoir hole has a diameter of 100 micrometer and a depth of 370 micrometer.

The texture pattern for superoleophobic regions is transferred onto the positive photoresist layer on the front side of the substrate using stepper system (with a second photomask) 36. Fluorine based reactive ion etching ($CH_3F/O_2$) can be used to define a textured pattern in the silicon oxide layer and a second fluorine based ($SF_6/O_2$) reactive ion etching process can be used to create the textured pillars having overhang re-entrant structures 38. Optionally a Xenon difluoride isotropic etching process can be applied to enhance the degree of overhang on textured pillars. $XeF_2$ vapor phase etching exhibits nearly infinite selectivity of silicon to silicon dioxide which is the cap material. The etch depth or texture height can be from about 0.1 to about 5 micrometer. A thick photoresist is spin-coated or spray coated on the front side of the substrate 40, and patterned the nozzle hole using the stepper and a third photomask 42. The thick photoresist layer may be from about 1 to about 15 micrometer. In specific embodiments, the thickness is about 6 micrometer. The front side is then etched to create the nozzle hole and the anisotropic etching process is stopped by etching selectivity between silicon and silicon oxide (layer). The etch depth may be from about 20 to about 50 micrometers, or from about 25 to about 45 micrometers. In specific embodiments, the etch depth is about 30 micrometer. In further embodiments, the diameter of the nozzle hole has a diameter of from about 20 to about 60 micrometers, or from about 30 to about 50 micrometers. In specific embodiments, the diameter of the nozzle hole is 40 micrometer. Thus, in specific embodiments, the texture pattern is made by patterning and etching in one layer and subsequently patterning and etching in a second layer.

The etch stopper layer (silicon oxide) is removed by the buffered oxide etch (BOE) process 44 and the final structure (overhang re-entrant structures 20) is ready for surface modification with an oleophobic conformal coating. After surface texturing, the entire patterned surface is coated with a conformal oleophobic coating (not shown), such as a self-assembled layer (FOTS) synthesized from fluorooctyltrichlorosilane or fluorodecyltrichlorosilane, as described earlier. This will impart superoleophobicity on the entire front face.

This textured nozzle front face will be superoleophobic and will overcome the wetting and drooling problems that can be problematic in certain current printheads. If desired, pillars can have a pillar height of 3 micrometers. Further, superoleophobicity can be maintained with pillar height as low as 200 nm depending on the pillar diameter and spacing. With reduced pillar height, the mechanical robustness of the shallow textured patterns increases. Textured surfaces with short pillars provide the additional benefits of not trapping dust particles and substantially enhancing the abrasion resistance. Very little to no surface damage is observed when manually rubbing these superoleophobic patterns.

It is worth to point out, in FIGS. 1, 2 and 3, although pillar structures are shown for describing the process, groove structures can be made via the same process, with the groove designs on the photomask.

Figure 4:
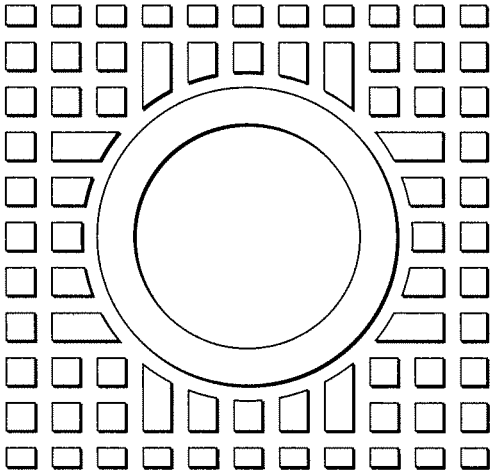
FIG. 4 is an illustration of a textured superoleophobic nozzle plate configuration according to the present embodiments.
Figure 5:
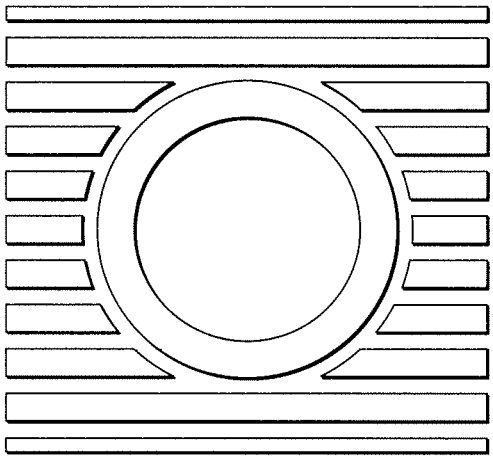
FIG. 5 is an illustration of an alternative textured superoleophobic nozzle plate configuration according to the present embodiments.

In further embodiments, an unbroken solid (not etched) ring can be disposed around the nozzle in order to avoid having ink from the nozzle travel laterally and get under the pillars or grooves. FIG. 4 illustrates the textured superoleophobic nozzle plate configuration with pillar structures. FIG. 5 illustrates the textured superoleophobic nozzle plate configuration with groove structures. With this configuration, when ink spills over the surface it is forced to come at the patterned geometry from the top, not the side (where it would degenerate into the Wenzel state). In this manner, when flooding does occur (e.g. during printhead priming) or ink gets on the front face for any other reason, the ink will tend to roll off, resulting in less contaminations and thus providing better image quality. In embodiments, the ring has a diameter larger than the diameter of nozzle holes and is from about 30 to 100 micrometers. In embodiments, the ring has a space of about 0.1 to 15 micrometers from the textured patterns comprising a pillar pattern or groove pattern.

In the subtractive (etched) fabrication process, the ring can be etched right in the silicon, so it isn't "attached" per say. In this case, the nozzle and the ring are both carved out of the same silicon layer. Or, alternately, the silicon ring can also have a wide top of silicon dioxide, or metal, or some other dissimilar material to create a reentrant structure. Alternatively, in the additive case (layers are deposited), the ring can be made of deposited silicon, oxide, polymer, metal, etc. In this embodiment, the layers can be deposited on top of the silicon, so no adhesive is required (with care taken to assure the ring material adheres properly). The present inventors have demonstrated that superoleophobic surfaces (for example, wherein hexadecane droplets form a contact angle of greater than about 140° and a sliding angle of less than about 10° with the surface) can be fabricated by simple photolithography and surface modification techniques on a silicon wafer. The prepared superoleophobic silicon surface is very "ink phobic" and has the surface properties very desirable for the front face or nozzle plates of inkjet printheads, for example, high contact angle with ink for super de-wetting and high holding pressure and low sliding angle for self clean and easy clean. Generally, the greater the ink contact angle the better (higher) the holding pressure. Holding pressure measures the ability of the aperture plate to avoid ink weeping out of the nozzle opening when the pressure of the ink tank (reservoir) increases.

The superoleophobic surfaces described herein can be particularly suitable for use as front face materials for ink jet printheads. In embodiments, an ink jet printhead herein comprises a nozzle plate comprising silicon, wherein the silicon comprises a textured pattern; and an optional fluorosilane coating disposed on the textured silicon surface. In further embodiments, an ink jet print head herein comprises a front face or nozzle plate comprising silicon, wherein the silicon comprises a textured pattern; and an optional fluorosilane coating disposed on the textured silicon surface.

In embodiments, the present ink jet print heads are self-cleaning such that a wiper blade or other contact cleaning mechanisms is not required. Alternately, the present ink jet print heads enable use of a non-contact cleaning system, such as an air knife system, thereby eliminating the need for potting of full-width array heads, allowing defective subunits to be more easily replaced after jet testing.

The present ink jet print head front face or nozzle plates comprise textured silicon surfaces, such as patterns of shallow (for example, less than about 5 micrometer) grooves, pillars (or posts), or pillars posts with oversized caps/overhang re-entrant structures on the nozzle front face. This textured nozzle front face is technically oleophobic which increases the contact angle of the ink significantly together with low sliding angles. The textured silicon nozzle front face can be used in combination with front face coatings. The present process and nozzle plates prepared therewith provide a number of advantages including, but not limited to: a) an improved containment of the meniscus, making jetting more reproducible and reducing flooding; b) when flooding does occur or ink gets on the front face for any other reason, it tends to roll right off, resulting in fewer missing or misdirected jets; c) improved image quality; d) reduced frequency of front-face maintenance thereby reducing down time and wasted supplies, and minimizing wear on any front face coating disposed over the textured front face; f) during wirebond encapsulation, the hydrophobic/oleophobic front face helps prevent encapsulant from spilling onto the nozzle plate and getting into the nozzles; g) allows for patterning certain portions of the nozzle plate, which enables ink to be directed away from the nozzles.

In embodiments, the present enhanced ink-phobicity of the front face or nozzle plate surface, renders the wiper blade cleaning system unnecessary. Therefore, the wiper blade can be replaced with a non-contact cleaning system, which has several advantages. First, a non-contact cleaning system eliminates blade-induced wear on the surface, and allows for more flexibility in choice of coating. Second, full-width array heads typically require the cracks between subunits to be filled in (potted) to prevent sharp die edges from damaging the rubber blade, but this potting makes it difficult to remove defective or failed subunits. The potting would have to be removed, which is difficult, and it would have to be replaced without clogging or damaging the new or existing subunits. The present non-contact maintenance scheme reduces or eliminates altogether the need for potting.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. An ink jet print head front face or nozzle plate having a textured superoleophobic surface comprising:

a silicon substrate having a front side and a back side;

an ink reservoir formed in the back side of the silicon substrate;

a textured pattern formed into the front side of the silicon substrate;

one or more nozzle holes formed into the silicon substrate to form one or more nozzle holes for the ink jet print head front face or nozzle plate; and a ring formed around a circumference of the one or more nozzle holes; and a conformal oleophobic coating disposed on the textured pattern.

2. The ink jet print head front face or nozzle plate of claim 1, wherein the textured pattern comprises an array of pillars, an array of pillars having an overhang re-entrant structure disposed on said pillars, an array of pillars having textured, wavy sidewalls, or a combination thereof.

3. The ink jet print head front face or nozzle plate of claim 1, wherein the textured pattern comprises an array of pillars having a pillar height of about 100 nm to about 5 micrometers.

4. The ink jet print head front face or nozzle plate of claim 1, wherein the textured pattern comprises an array of pillars having a solid area coverage of from about 0.5% to about 50%.

5. The ink jet print head front face or nozzle plate of claim 1, wherein the textured pattern comprises an array of pillars having a diameter of from about 100 nanometers to about 10 micrometers.

6. The ink jet print head front face or nozzle plate of claim 1, wherein the textured pattern comprises an array of pillars having a shape selected from the group consisting of round, elliptical, square, rectangular, triangle, and star-shaped.

7. The ink jet print head front face or nozzle plate of claim 1, wherein the textured pattern comprises a groove pattern, a groove pattern including an overhang re-entrant structure, a groove pattern including textured, wavy sidewalls, or a combination thereof.

8. The ink jet print head front face or nozzle plate of claim 1, wherein the groove pattern comprises a total height of about 100 nm to about 5 micrometers.

9. The ink jet print head front face or nozzle plate of claim 1, wherein the textured pattern comprises a groove pattern having a solid area coverage of from about 1% to about 80%.

10. The ink jet print head front face or nozzle plate of claim 1, wherein the textured pattern comprises a groove pattern having a width of from about 100 nm to about 10 micrometers.

11. The ink jet print head front face or nozzle plate of claim 1, wherein the silicon substrate has an ink reservoir formed in a side opposite the textured pattern.

12. The ink jet print head front face or nozzle plate of claim 1, wherein the one or more nozzle holes have a diameter of from about 20 to about 60 micrometers.

13. The ink jet print head front face or nozzle plate of claim 1, wherein the one or more nozzle holes have a depth of from about 10 to about 60 micrometers.

14. The ink jet print head front face or nozzle plate of claim 1, wherein the ring is etched into the silicon substrate.

15. The ink jet print head front face or nozzle plate of claim 1, wherein the ring has a diameter larger than the diameter of nozzle holes and is from about 21 micrometers to about 100 micrometers.

16. The ink jet print head front face or nozzle plate of claim 1, wherein the ring has a space of about 0.5 to 15 micrometers from the textured patterns comprising a pillar pattern or groove pattern.

17. The ink jet print head front face or nozzle plate of claim 1, wherein the ring has a wide top to form a re-entrant structure on its outside edge.

18. The ink jet print head front face or nozzle plate of claim 1, wherein the ring comprises additive layers selected from the group consisting of wide top comprises a material dissimilar from the ring material selected from the group consisting of deposited silicon, deposited oxide, deposited polymer, deposited metal, and mixtures thereof.

19. The ink jet print head front face or nozzle plate of claim 1, wherein the textured superoleophobic surface has a contact angle of from about 120° to about 175° as formed by a hydrocarbon-based liquid or water.

20. The ink jet print head front face or nozzle plate of claim 1, wherein the textured superoleophobic surface has a sliding angle of from about 1° to about 30° as formed by a hydrocarbon-based liquid or water.

21. An ink jet print head front face or nozzle plate comprising:

a silicon substrate;

a textured pattern formed into one side of the silicon substrate;

one or more nozzle holes formed into the one side of the silicon substrate to form one or more nozzle holes in the ink jet print head front face or nozzle plate;

a ring formed around a circumference of the one or more nozzle holes; and a conformal oleophobic coating disposed on the textured pattern, wherein the textured pattern comprises one or more fluorosilane layers synthesized through molecular vapor deposition, vapor phase technique, or solution coating and further comprises a self-assembled layer synthesized from the group consisting of tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, and heptadecafluoro-1,1,2,2-tetrahydrooctyltriethoxysilane.

22. An ink jet print head front face or nozzle plate comprising:

a silicon substrate;

a textured pattern formed into one side of the silicon substrate;

one or more nozzle holes formed into the one side of the silicon substrate to form one or more nozzle holes in the ink jet print head front face or nozzle plate; and a ring formed around a circumference of the one or more nozzle holes; and a conformal oleophobic coating disposed by e-beam deposition, thermal deposition, sputtering or solution coating on the textured pattern, wherein the textured pattern comprises one or more of coating materials selected from the group consisting of an amorphous fluoropolymer, a perfluoropolyether polymer, and mixtures thereof.

* * * * *